United States Patent [19]

Otters

[11] Patent Number: 4,722,188

[45] Date of Patent: Feb. 2, 1988

[54] REFRACTORY INSULATION OF HOT END IN STIRLING TYPE THERMAL MACHINES

[76] Inventor: John L. Otters, 11317 Miller Rd., Whittier, Calif. 90604

[21] Appl. No.: 920,198

[22] Filed: Oct. 17, 1986

Related U.S. Application Data

[63] Continuation-in-part of Ser. No. 790,039, Oct. 22, 1985, Pat. No. 4,638,633.

[51] Int. Cl.[4] ..... F02G 1/04

[52] U.S. Cl. ..... 60/517; 60/520

[58] Field of Search ..... 60/517, 520, 525, 526; 62/6; 123/193 C; 92/169, 170, 171

[56] References Cited

U.S. PATENT DOCUMENTS 3,861,146 1/1975 Lynch et al. ..... 60/526 X 4,523,554 6/1985 Ryu ..... 123/193 C

*Primary Examiner*—Stephen F. Husar

*Attorney, Agent, or Firm*—Natan Epstein; William H. Pavitt, Jr.

[57] ABSTRACT

A high temperature resistant liner of refractory material is used to line the displacer chamber so as to permit engine operation at temperature beyond those possible with metallic chamber walls. A compression sleeve or ring of high tensile strength material circumferentially encompasses the liner and preloads the liner against the forces of the highly pressurized working fluid in the displacer chamber.

3 Claims, 13 Drawing Figures

44
48
52
17
20
16
28
26
24
24a
58
34
10
96
14
24c
68
70b
70a
62a
32
64
30
24
24b
74a
36a
74b
36c
22
19
85
90
38
36
12
84a
80
84
82
76
76
35
37
72
94
88
86
98
39
92
36b
66
40
90a
62b
18
42
56
50
46
100
102
78
79

134
132
126
136
138
140
141
142
128
130
48'
55
124
168
166
14
160
34
164
30
55
152
154
68
24
156
64
70a
62a
32
12
96
70b
74b
76
146
144
37a
37b
36a
123
38
36
122
35
36c
98
120
118
94
60
185
36d
14
40
96a
78
66
18
56
62b
79
42
50
102

REFRACTORY INSULATION OF HOT END IN STIRLING TYPE THERMAL MACHINES

This application is a continuation in part of Ser. No. 06/790,039 filed Oct. 22, 1985, now U.S. Pat. No. 4,638,633.

BACKGROUND OF THE INVENTION

1. Field of the Invention

The present invention relates generally to the field of Stirling or similar cycle thermal machines and is more particularly directed to a thermal machine sealed within an outer shell enclosure which maintains the engine components in an axially compressed state to thereby simplify construction of the engine while maintaining a sealed atmosphere of working fluid about the engine thereby minimizing leakage seal problems and also providing a containment enclosure about the engine in the event of explosive failure of the same.

2. State of the Prior Art

The present invention is generally directed to thermal machines of the general type wherein a working fluid is subjected to a thermodynamic cycle within a chamber by reciprocating a displacer body within the chamber for displacing the working fluid between a hot and a cold space in the chamber. In the case of an engine a heat input is provided and the resulting cyclic variations in working fluid pressure may drive a work piston so as to derive a work output. Conversely, a work input may reciprocate a compressor piston so as to alternately compress and expand the working fluid. The resulting cyclic variations in working fluid temperature are used in a refrigerator for cooling one end of the working fluid chamber in a manner well known in the art.

In either case, the working fluid is usually contained at a relatively high pressure and presents problems in terms of leakage both around the work piston through the dynamic seal between such piston and its cylinder wall, and also through various joints and connections in the machine housing to the outer atmosphere. The control of such leaks, particularly in cases where the working fluid is flammable, such as hydrogen, has been a source of continuing difficulty to which many solutions have been proposed.

The thermodynamic efficiency of such thermal machines is dependent in part on the mean pressure of the working gas and on the temperature differential between the hot and cold spaces of the displacer chamber. In an engine, greater efficiency can be obtained by supercharging the displacer chamber with working gas at very high pressures and then operating the engine at the greatest possible temperature differential between the hot and cold ends of the displacer chamber, thus heating the already highly pressurized working gas to very high temperatures. In practice however, the maximum safe operating pressures and temperatures of Stirling and similar engines are limited by the physical properties of the materials used in constructing the engine and on the construction and assembly techniques used.

Stirling cycle and similar machines are often designed along a main axis extending between a thermal end which receives the heat input and opposite work end at which work is either delivered in an engine or applied in the case of a refrigerator. Temperatures of engine components vary greatly at different points along the main axis, typically reaching extremes at the thermal end and graduating to near ambient temperature at the work end.

The bodies or housings of such machines are typically assembled in several axial body sections which are secured to one another by means of radial flanges on each body section. The flanges are bolted, screwed or clamped together to hold the various sections against the internal operating pressures of the machine and in combination with sealing rings or gaskets to make high pressure gas tight seals where needed to contain any pressurized fluids within the machine. Greater working fluid pressure require increasingly heavy cylinder walls at the same time that the strength of the engine body material is degraded as operating temperatures are increased. Metal alloys conventionally used in making machine body sections thus set upper limits to the working fluid pressures and temperatures which fall short of the operating parameters desirable for optimum machine efficiency.

Recent advances in material technology have produced new categories or materials, particularly ceramics, capable of withstanding substantially higher temperatures and pressures than metallic alloys normally used for engine components. While it would be advantageous to incorporate ceramic parts into thermal machines and particularly into external combustion engines in cases where operating temperatures exceed 1,100 degrees Centigrade (approximately 2,000 F.), difficulties exist in assembling a hybrid engine comprising both ceramic and metallic parts due to their dissimilar mechanical characteristics, particularly their varying coefficients of thermal expansion. In external combustion engines for example, it has been found advantageous to use ceramic material such as silicon carbide for the engine heater head while retaining metallic materials for the cooler sections of the engine. Ceramic materials while able to withstand substantial pressures, are more brittle than metallic components and thus do not flex readily under the compound stresses frequently imposed by fasteners, e.g. bolts, tie-rods, etc., normally used to assemble the axial sections comprising the machine body. The use of brittle materials for the heater head is complicated not only by the different mechanical properties at high temperatures, but also because the ceramic material is limited in the amount of working fluid pressure which it will safely tolerate due to its brittleness, particularly at high temperatures. Further, the physical properties of ceramic materials are less uniform and predictable than those of metallic alloys and the use of ceramics therefore calls for higher design safety margins. Even where the machine body sections are made of similar materials, e.g. all steel bodies, conventional assembly techniques call for relatively massive radial flanges on each body section which are bolted or clamped together. As operating pressures and temperatures are increased these flanges as well as the cylinder walls of the machine body must be made increasingly heavy, practical considerations ultimately limiting the maximum safe operating pressures and temperatures.

Another problem area in Stirling cycle machines has been adequate control over leakage of the pressurized working fluid. The working fluid is contained in a displacer chamber where it is subjected to a thermodynamic cycle with consequent expansion and contraction of the working fluid. The cyclical variations in working fluid pressure drive a work piston from which a work output is derived. In many previous engine designs, fluid leakage around the work piston has been a continuing source of difficulty, both in terms of contamination of the working fluid by extraneous fluids (e.g. hydraulic fluid pumped by the work piston) and also loss of pressurized working fluid through leakage around the work piston. One solution to this problem has been proposed by this applicant in U.S. Pat. No. 4,489,554, consisting of a compound work piston where two piston elements are connected by an axial, small diameter linkage which is easier to seal than the larger diameter piston and which may also form part of a pumping arrangement designed to recover leaking working fluid, either by returning the same to the displacer chamber or by feeding it to the engine burner for combustion.

Further improvement of Stirling cycle and similar machines is needed to overcome the aforementioned difficulties.

SUMMARY OF THE INVENTION

The present invention seeks to overcome these and other shortcomings of the prior art by providing a hermetically sealed outer shell or vessel fully enclosing the thermal machine, which may be configured as either an engine or refrigerator.

The outer shell may be tubular and closed at two opposite shell ends, the central longitudinal axis of the shell being aligned with the axis of the thermal machine such that the two axial ends of the machine body are maintained in compression between the two shell ends. The outer shell is dimensioned and constructed for maintaining the thermal machine body in a normal state of axial compression along the main longitudinal axis of the machine body in cooperation with a pre-loading device. Thus a machine body consisting of several distinct axial elements or sections can be held together axially by nothing more than the compressive force exerted thereon, advantageously replacing the flange-and-fastener approach presently required to interconnect the various axial components of such a machine body. The outer shell is maintained in a normal state of tension relative to the machine body either by one or more pre-loading devices axially interposed in compression between the machine body and the outer shell, thereby maintaining the machine body in axial compression. In the alternative the outer shell may be appropriately undersized axially relative to the machine body so as to stretch the shell axially between the machine body ends. The tensile force on the outer shell is desirably transmitted through a spherical aligner interposed between the shell and the machine body at each end of the shell so as to compensate for possible deviations in the axial alignment of the machine body sections thereby to maintain the outer shell in pure axial tension notwithstanding inaccuracies in the axial alignment of the machine body sections.

The present invention eliminates the use of fasteners particularly for axially interconnecting machine body sections of dissimilar or similar materials, as for example attaching a ceramic hot head to metallic machine body portions. At the same time, the resistance of the ceramic elements to high internal pressure at temperature extremes is increased by maintaining the ceramic material in axial compression without being subjected to the compound stresses which would be imposed on the ceramic sections if conventional flanges and fasteners were used.

Bolted flanges have a tendency to exert compound stresses on the machine body components which are poorly tolerated by ceramic or similarly brittle material. The use of an outer shell makes possible the application of axial or column loading on the various machine body sections so as to form high pressure seals between the machine body sections regardless of similarity of material. For example, a brittle ceramic hot end of an engine can be axially compressed against axially adjacent body sections to maintain the high pressure seal necessary to contain highly pressurized working fluid and in fact thereby increasing the brittle ceramic material's resistance to high internal engine pressure.

The outer shell of this invention facilitates use of ceramic body elements thus allowing operation of the machine along a thermodynamic cycle extending between greater temperature extremes, while the containment and shielding functions of the outer shell permit increased operating pressures, thereby improving thermodynamic cycle efficiency.

A high temperature resistant liner of refractory material may be used to line the displacer chamber so as to permit engine operation at temperatures beyond those possible with metallic chamber walls, with a compression sleeve or ring of high tensile strength material circumferentially encompassing the liner and applying radially inward compressive force to pre-load the liner against the tensile forces acting thereon due to containment of highly pressurized working fluid in the displacer chamber. It thus becomes possible to use brittle but highly temperature resistant liner materials, such as ceramics, characterized by high compressive strength but relatively weak tensile strength, in applications where such use has been considered impractical until now. The refractory displacer chamber lining insulates the hot end of the thermal machine from the remaining cooler sections of the machine body maintaining maximum temperature differential between the displacer chamber hot and cold ends for improved machine efficiency, while permitting machine operation at temperatures higher than possible with metallic components. While the claimed improvement is described and illustrated in connection with a thermal machine having the aforementioned outer shell, the refractory insulation concept here disclosed is not limited to use with such machines but may also find application with otherwise conventional Stirling type engines and machines.

These and other advantages of the present invention will be better understood by reference to the accompanying drawings taken in light of the following detailed description of the preferred embodiments.

BRIEF DESCRIPTION OF THE DRAWINGS

FIG. 5b is a fragmentary longitudinal section showing the seal between the output shaft and the outer shell in FIG. 5a.

DETAILED DESCRIPTION OF THE PREFERRED EMBODIMENTS

Figure 1:
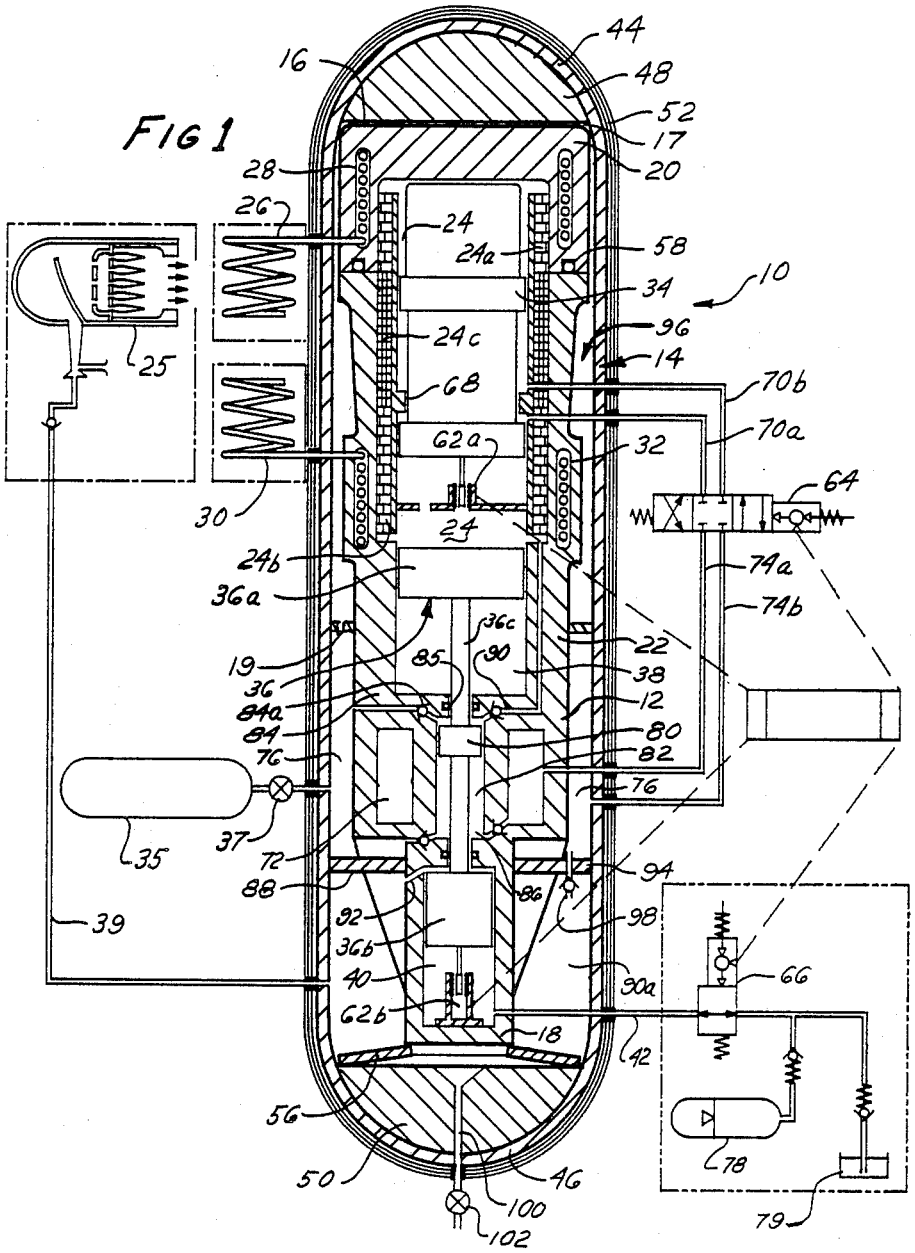
FIG. 1 is a longitudinal section of a Stirling engine constructed according to this invention characterized by a heat source external to the outer shell and a hydraulic output.

With reference to the drawings, FIG. 1 shows an improved thermal machine 10 comprising a Stirling cycle engine 12 enclosed within an outer shell 14. The engine 12 is arranged along a main engine axis extending between a hot thermal end 16 and an opposite work output end 18. The body of engine 12 comprises a heater head section 20 made of a ceramic such as Silicon Carbide and a metallic body section 22 constituting the remainder of the engine body. A displacer chamber 24 is partly defined by the ceramic head 20 and partly by the metallic portion 22 and is filled with a suitable working fluid such as hydrogen or helium gas. The hot and cold spaces of the displacer chamber 24 are provided with heat exchangers 24a and 24b respectively and a regenerator 24c connecting the hot and cold ends of said chamber. The heater head 20 is heated as by sodium vapor supplied by heat pipe 26 to engine heater coil 28. The heat input to the engine 12 is provided by a gas burner 25 external to the outer shell 14. The cold end of the displacer chamber 24 is cooled by a suitable fluid such as ammonia supplied to cooling coil 32 by heat pipe 30. The working fluid within the displacer chamber is subjected to a thermodynamic cycle by being displaced between the hot and cold ends of the displacer chamber in response to reciprocating movement of displacer 34. The resulting cyclic variations in working fluid pressure drive a compound work piston 36 against a gas spring 38. In the illustrated embodiment, the compound work piston includes a first piston element 36a driven by the working fluid and a second piston element 36b connected by a relatively small diameter axial rod or linkage 36c to the element 36a. The element 36b pumps a hydraulic fluid in chamber 40 through an output line 42.

Figure 3:
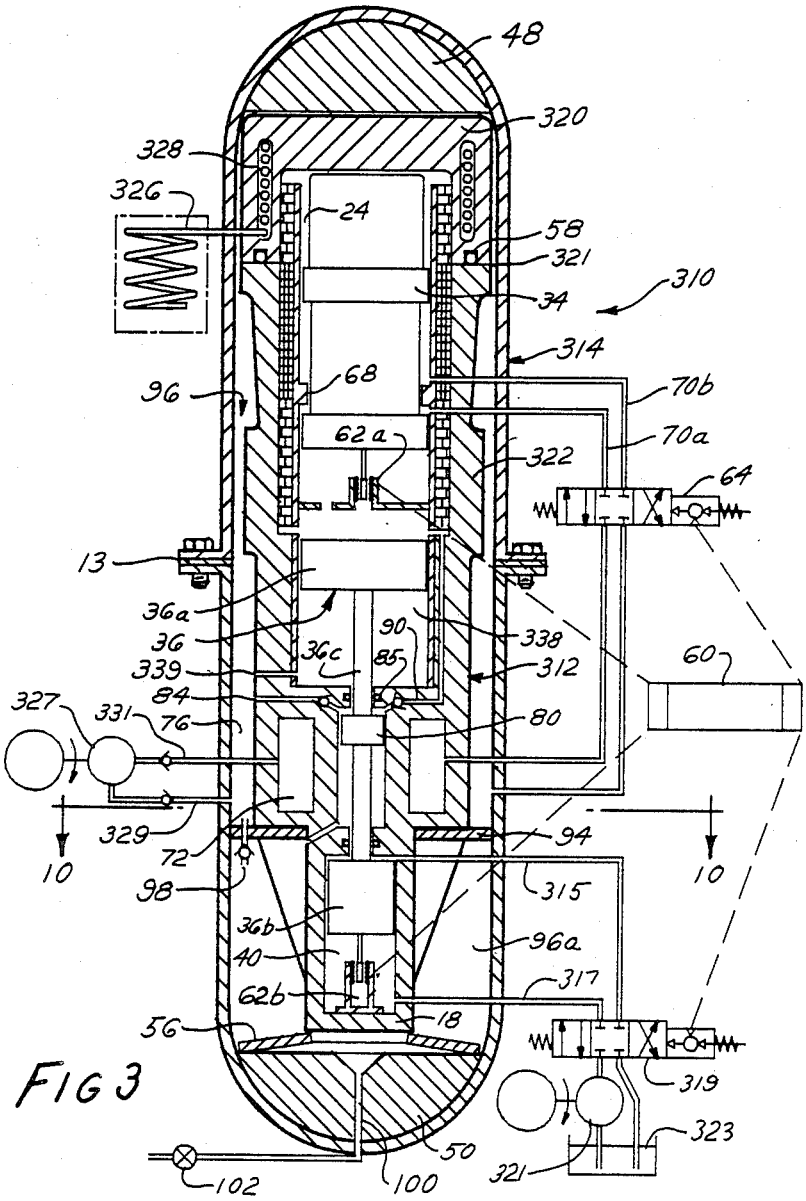
FIG. 3 is a longitudinal section of a Stirling cycle refrigerator according to this invention.

The outer shell 14 is cylindrical in cross-section and is terminated by an upper hemispherical end portion 44 and lower hemispherical end portion 46. The shell may be made in two halves joined at the midline of the shell cylinder as shown in FIG. 3 by means of flanges 13 bolted, screwed or clamped together as in conventional high pressure vessel construction, particularly autoclave vessels. In small units it may be desirable to weld the two shell halves together to make a sealed vessel which can be readily cut open at the weld line if repairs to the machine enclosed therein become necessary. The shell may be made of metal such as high strength steel, high strength aluminum, or mild steel, or in the alternative plastic or composite materials may be used. The shell halves may be made by casting, forging, or deep drawing methods, or may be fabricated from rolled sheet metal welded to pressure formed end caps. The outer shell or envelope 14 may be reinforced by winding a continuous high strength glass or carbon fiber filament either circumferentially, longitudinally or both to make an outer filament layer 52 over the hermetically sealed wall of the shell 14, thereby to put the shell 14 in compression according to the direction of the filament winding.

Interposed between the hemispherical end portions of the outer shell and the corresponding end of the engine body are two spherical aligners 48 and 50. Each aligner is shown as a solid hemispherical body, although it may be partially hollowed out for weight savings, and having a smooth outer spherically curved surface and a plane circular inner surface. The outwardly facing spherical surfaces of the two aligners fit closely within and are slideable against the spherically concave inner end surfaces of the outer shell 14.

The upper spherical aligner 48 has a planar inner face acting against the flat upper end 16 of the ceramic heater head 20 through a zirconia ceramic flat pad insulator 17. The lower end 18 of the engine is supported by a Belleville type pre-loading spring 56 compressed between the engine end 18 and the spherical aligner 50 for compressively loading the engine body assembly between the two spherical aligners 48 and 50. The preloading spring is selected to apply a compressive force to the machine body substantially in excess of the maximum internal operating pressures in the engine body 12 acting to axially separate the body sections 20 and 22 so as to maintain the engine body 12 under axial compression at all times and ensure the integrity of the gas seal 58 against internal operating pressures. In the event of axial misalignment of the various engine body sections causing the longitudinal axis of the engine 12 to move out of alignment with the central longitudinal axis of the outer shell 14, one or both of the spherical aligners 48 and 50 are able to rotate against their corresponding spherical end cap 44, 46 so as to maintain alignment of the compressive force along the central axis of the outer shell 14 and prevent imposition of a bending moment on the outer shell resulting from such misalignment. Vertical alignment of the engine body may further be assured against lateral buckling due to the axial loading of the engine body by provision of a transverse support 19 connecting the engine body to the wall of the outer shell at a longitudinally intemediate point thereof. The support is perforated or apertured for allowing free flow of gas therethrough.

This outer shell arrangement maintains the ceramic head 20 in axial compression against the metallic engine block section 22 while the outer shell is in axial tension between the two spherical aligners under the loading of spring 56. A gas tight seal for containing the pressurized working gas in displacer chamber 24 is maintained between the ceramic head 20 and engine block 22 by providing a static seal ring 58 set into a circular groove formed in one or both of the ceramic head 20 and the upper end of the metallic engine block 22. The seal is maintained only by the axial compressive force acting on the engine body sections and no other fastener is used to hold together the engine body sections nor to maintain the seal between the ceramic head and metallic engine block. In certain cases, such as small engine or machine bodies a gas tight seal can be secured by merely lapping flat the mating surfaces of the axially adjacent body sections which are then held tightly against each other by the force of the pre-loading spring 56. It is desirable in any case to provide locating rings (not shown) set in aligned grooves in the mating surfaces or similar means for holding the adjacent engine body sections in radial alignment and against radial shifting relative to each other. It is understood that the engine body and particularly section 22 thereof may consist of a greater number of discrete axial sections held together axially by the force applied by pre-loading spring 56 relative to the tensed outer shell 14.

As the engine is charged with pressurized working fluid following initial assembly, and as the working fluid and engine components are heated during engine operation, misalignment of the axial engine geometry resulting from thermal expansion are accommodated by movement of the spherical aligners.

In a practical engine constructed according to this invention, the body of engine 12 would be surrounded by layers of heat insulating material (not shown in the drawings) and the diameter of the outer shell 14 is desirably sized so as to enclose a volume greater than the volume occupied therein by the actual engine 12. This provides a buffer space 96 sufficient to allow decompression of explosively released working gas to a pressure which can be contained by the wall of the outer shell 14. Thus the shell 14 not only is intended to contain flying fragments resulting from catastrophic failure of the engine, but to also contain explosive release of gas resulting from failure of any part of the engine 12.

The top of the hydraulic fluid chamber 40 is vented to the low pressure buffer space by passage 92 and the buffer space enclosed by the outer shell 14 id divided by a transverse bulkhead 94 into a lower buffer space **96*a* and an upper buffer space 76. The lower space 96*a* is isolated by the bulkhead 94 and a pressure equalizing anti-contamination check valve 98 to prevent contamination of the upper space 76 due to possible out-gassing from the hydraulic fluid in chamber 40 into the lower buffer space. Any leakage of hydraulic fluid through passage 92 from the engine into the lower buffer space 96*a* is drained through a drain conduit 100 provided with a drain valve 102 and extending through the lower spherical aligner 50 and through a pressure seal in shell 14**.

The engine cycle is controlled by means of engine controller 60 which receives input information derived from position sensors such as LVDT position sensors **62*a* and 62*b*. The input information is indicative respectively of the position of the displacer 34 and piston 36 along their respective strokes. The engine controller 60 derives an output control signal based on said input information which controls a four-way servo valve 64 and a two-way servo valve 66. The valve 64 pneumatically controls the motion of the displacer 34 by applying a controlled pressure differential across a dynamic seal 68 through pneumatic lines 70*a* and 70*b*. The pneumatic displacer drive is supplied with high pressure gas through supply line 74*a* from an annular gas storage reservoir 72 defined in the engine body section 22 while a pressure sink is obtained through return line 74*b* connected to the sealed buffer space 96 defined between the outer shell 14 and the engine 12**, and which is filled with working gas at atmospheric or preferably somewhat above atmospheric pressure.

The engine controller 60 controls the direction and magnitude of the pressure differential between the pneumatic control lines **70*a* and 70*b* through the servo valve 64 to maintain positive control over the motion of displacer 34. The engine controller 60 also controls servo valve 66 which controls the volume of hydraulic fluid flow into and out of piston chamber 40 through conduit 42, i.e. both outflow to hydraulic pressure accumulator 78 and inflow from hydraulic fluid reservoir 79. The motion of the compound work piston 36 is thus likewise under positive control independently of the displacer 34** and therefore the phase relationship between the displacer and compound work pistion can be adjusted to obtain a desired engine cycle. For a more detailed description of such an engine control system reference is made to U.S. Pat. No. 4,489,554 issued to this applicant.

In a pneumatic engine control system such as this, it is advantageous to maintain the highest possible working fluid mean pressure in displacer chamber 24 so as to increase the stiffness of the working gas and thereby maintain more accurate control over the displacer. This objective is in accord with the aforementioned desirability of operating such engines at high working fluid pressures for improved thermodynamic efficiency. However, higher working fluid pressures also increase the risk of explosive failure of the engine body, particularly where brittle ceramic components are used. This hazard is safeguarded against by the outer shell 14 which forms both a decompression buffer space 96 and presents a physical barrier against flying fragments. Provision of such buffer space not only eliminates or greatly diminishes the usual problems of sealing two gases against each other, such as highly pressurized hydrogen working gas v. atmospheric air, but also provides a reservoir for containing working gas leaking out of the displacer chamber 24 and which can then be repressurized for use in the pneumatic control system or returned to the displacer chamber 24. This is achieved by a an internal gas pump arrangement comprising a gas pump pistion 80 affixed on work piston linkage rod **36*c* of the compound work pistion 36 and which reciprocates within a pump chamber 82 sealed at each end by dynamic seals 85. On the down stroke of the work pistion 36 gas is drawn from the low pressure buffer space 76 through intake conduit 84 and check valve 84*a*, while gas present in the pump chamber 82 below piston 80 is pumped through outlet conduit 86 into the high pressure gas storage chamber 72 for use in the pneumatic control system. On the up stroke of the pump piston 80, gas is drawn from the low pressure buffer space 76 through inlet conduit 88 while gas present in the pump chamber 82 above the piston 80 is pumped through outlet conduit 90 into the displacer chamber 24, thereby maintaining working fluid pressure there. A working gas supply tank 35 connected through pressure regulating valve 37 to the upper buffer space 76 provides the working gas necessary to run the entire system, supplying gas as fuel to the engine burner 25 through check valve 98 in the transverse baffle 94 and burner supply line 39 connected to the lower buffer space 96*a***.

It will be appreciated that provision of the outer shell 14 thus permits operation of the engine 12, including a working gas leakage control system and a pneumatic engine control, as a closed system sealed aganst loss of working fluid to the outer environment.

Figure 2:
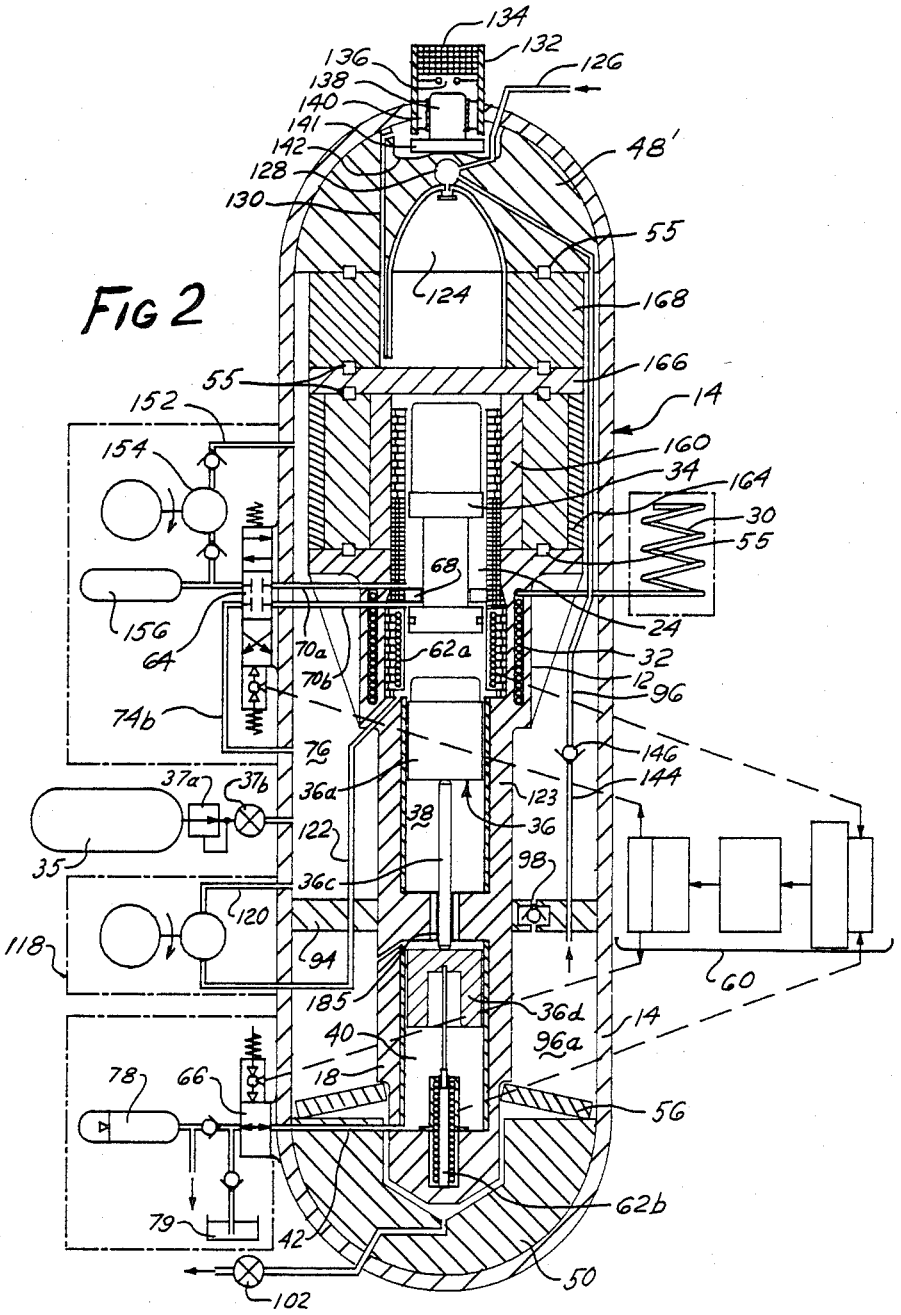
FIG. 2 is a longitudinal section of a second embodiment of the novel Stirling engine powered by a gas burner internal to the engine's outer shell.

The engine of FIG. 2 differs in several respects from the embodiment of FIG. 1, but like elements bear like numbers. A first difference is the use of an external motor driven gas pump 118 for pressurizing working gas drawn from the low pressure upper buffer space through intake conduit 120 and returned to the displacer chamber by way of conduit 122. The motor driven pump 118 replaces the use of the pump piston 80 and associated components in FIG. 1.

Secondly, the FIG. 2 embodiment includes a gas combustor 124 internal to the outer shell 14 which is fed by a gas-air mixture consisting of atmospheric air drawn through intake conduit 126, mixed with combustible gas in mixing chamber 128, and then burned in combustion chamber 124. Exhaust gases produced by combustion are discharged through conduit 130 from the combustion chamber and vented to the atmosphere through an exhaust pipe 132 provided with a flame arrester 134 and leakage gas igniter 136. An anti-detonation valve 138 consists of a slideable plunger provided with a closure element 141 dimensioned to cover and close the vent passages 140, but which is in the normally open position shown in FIG. 2 allowing free out-flow of exhaust gas through the vent pipe 132. In the event that structural failure of the engine 12 or a detonation in the combustor chamber 124 releases pressurized gas into the buffer space, the high pressure front of suddenly released gas operates to push up and close the anti-detonation valve 138 so as to close the vent openings 140 with the enlarged bottom portion of the anti-detonation valve 138.

The gas fuel for the engine combustor 124 may be conveniently drawn from the low pressure lower buffer space **96*a* itself in those cases where the working fluid is combustible, as for example in the case of hydrogen gas. Thus, working gas lost from the displacer chamber through leakage into the buffer space 76 through any leak path in the engine can be recovered either for return to the displacer chamber and/or for use in fueling the engine combustor 124. In particular, in an engine provided with a transverse bulkhead 94 gas from the upper low pressure buffer chamber 76 may be compressed and returned to the displacer chamber while potentially contaminated gas from the lower low pressure buffer space 96*a* may be fed to the combustor chamber 124 through a conduit 144 provided with an anti-flashback check valve 146 and connected to mixing chamber 128**.

A working gas supply tank 35 similar to that of FIG. 1 is connected through pressure regulator **37*a* and valve 37*b* to the upper buffers space 76, and supplies working gas to the engine burner 124 through pressure equalizing valve 98 and lower buffer space 96*a*, then through combustor supply line 144 connected to mixing chamber 128. The working gas supply tank 35 also feeds the upper buffer space 76 from where working gas is drawn by conduit 152, pressurized by a motor driven pump 154 external to the outer shell 14 and stored in pressure vessel 156 for use in the pneumatic dispatcher drive and control system which includes four-way pneumatic valve 64 controlled by an output control signal derived by engine controller 60 as has been explained in connection with FIG. 1 for applying a controlled pressure differential across dynamic seal 68 by means of pneumatic lines 70*a* and 70*b*. The compound work piston 36 in FIG. 2 lacks the gas pump piston 80 and associated gas pump of FIG. 1 which has been replaced by external gas pump 154 powering the pneumatic displacer control system, and by external gas pump 118 for repressurizing the displacer chamber 24 with working gas drawn from upper buffer space 76 so as to make-up for leakage around the work piston element 36*a* and high pressure seal 185** or through other leakage paths.

In the engine of FIG. 2, a more complex and realistic hot end insulating assembly is shown consisting of a number of separate insulating elements of ceramic or equivalent material, as for example a cylindrical silicon carbide inner liner 160 surrounded by a high pressure insulating ring 162 of e.g. zirconia ceramic. Both ceramic rings 160 and 162 are held in radial compression by means of an outer compression ring 164 made of, e.g., high strength steel shrink-fit over insulating ring 162. The use of the compression ring 164 places the inner ceramic rings 160 and 162 under both radial as well as axial compression, thereby increasing the upper pressure limit at which the working gas may be safely operated in the displacer chamber 24. The three concentric rings 160, 162 and 164 comprise an engine body section held in axial compression between a transverse heater plate 166 and the upper end of the lower portion 123 of the engine body. The heater plate 166 may be of a heat conducting ceramic material such as silicon carbide formed with finned upper and lower surfaces for optimum heat exchanging characteristics. The upper surface of the plate 166 is heated by the burner 124 and the heat is transfered through the plate to the gas in the upper or hot end of the displacer chamber 24. The burner 124 is surrounded by an insulating ring 168 of a suitable material such as zirconia ceramic. It will be appreciated thus that the body of the engine in FIG. 2 is comprised of a number of axially assembled sections consisting of burner insulating ring 168, heater plate 166, displacer chamber insulation ring assembly including rings 160, 162 and 164, and the lower portion 123 of the engine body which includes the work piston assembly. The several engine body sections are held axially together only by the pre-loading spring 56 acting against the outer shell 14 through the spherical aligners 48' and 50. Locating rings 55 are provided in grooves formed in the mating surfaces of adjacent engine body section for fixing the sections against relative radial displacement. The locating rings 55 may be conventional locating rings fitted into grooves in the mating surfaces or such rings may be machined integrally in the mating surfaces. No other fasteners however are used nor required to maintain the various body sections in axially assembled relationship. Minor leakage of working gas between the mating surfaces of the various body sections is easily tolerated since the escaping gas flows into the buffer space enclosed by the outer shell 14 and not into the atmosphere, particularly since the system is provided with a pumping arrangement for repressurizing working gas drawn from the low pressure buffer space and replenishing the displacer chamber with pressurized working gas.

Figure 4A:
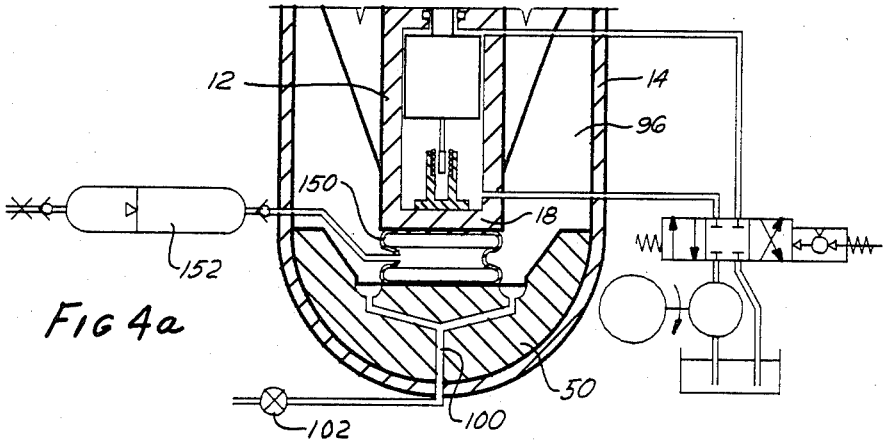
FIG. 4*a* is a fragmentary longitudinal section of a thermal machine showing use of a hydraulic pressure accumulator connected to a bellows for compressively pre-loading the machine body.
Figure 4B:
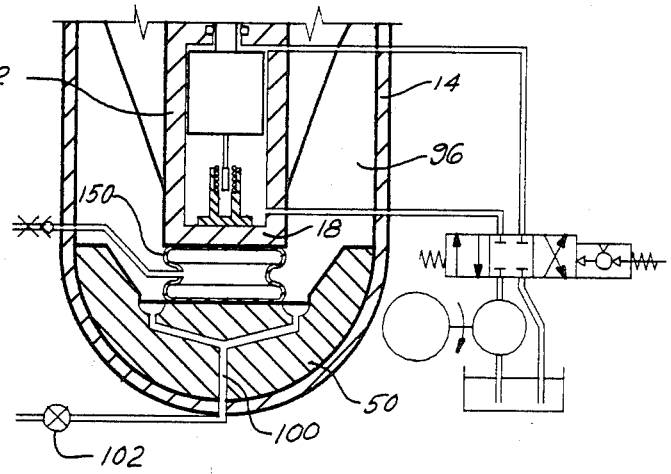
FIG. 4*b* is a fragmentary longitudinal section of a thermal machine showing use of a bellows filled with pressurized compressible fluid for compressively pre-loading the machine body.
Figure 4C:
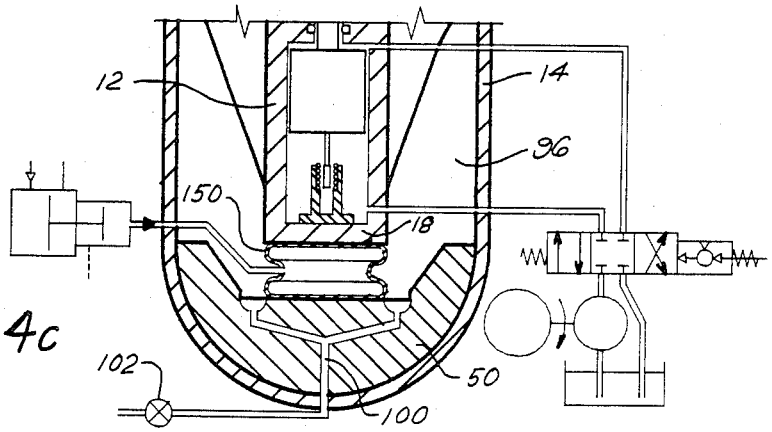
FIG. 4c is a partial longitudinal section of a thermal machine showing use of a pressure compensator unit charging a bellows for compressively pre-loading the machine body.

The pre-loading spring 56 is shown in both FIGS. 1 and 2 as a mechanical spring, specifically as a single or stacked Belleville washer arrangement. The pre-loading spring 56 may however take many other forms. For example, in FIGS. **4*a* through 4*c*, the Bellville spring 56 has been replaced by a bellows 150 interposed between the lower end 18 of a thermal machine 12 and lower spherical aligner 50 and expandable along the main engine axis. The bellows 150 may be pressurized by any suitable means, including the use of a hydraulic fluid accumulator 152 as a pressure source in FIG. 4***a*, by a charge of compressible liquid such as a compressible silicone based oil or by gas charge maintained at a sufficient pressure as in FIG. 4*b* or by use of an air-hydraulic intensifier connected to the bellows as in FIG. 4*c*, so as to provide the axial spring loading of the engine body assembly and thus maintain the outer shell 14 in tension while the thermal machine 12 is maintained in axial compression. FIGS. 4*a*–4*c* show only the lower or work input portion of a thermal machine configured as a refrigerator with a work pistion driven by a hydraulic input similar to the refrigerator of FIG. 3.

Figure 5C:
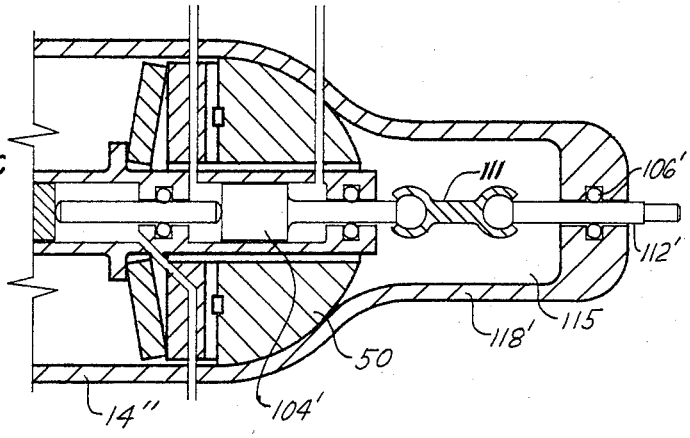
FIG. 5c is a fragmentary longitudinal section showing the sealing of an axially reciprocating output shaft.
Figure 5A:
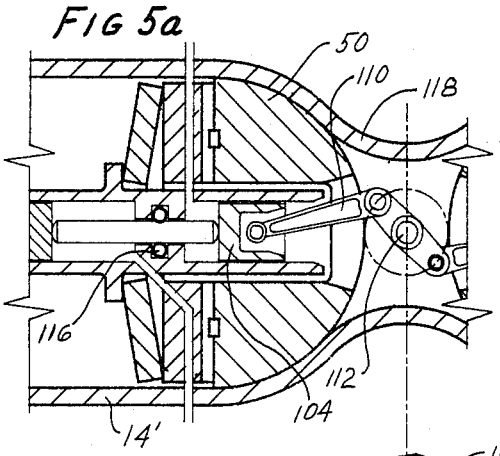
FIG. 5a is a fragmentary longitudinal section showing a mechanical crankshaft output arrangement for an engine enclosed in an outer shell according to this invention.

FIG. 5*a* illustrates a thermal machine comprising two engines each having a compound work piston 104 and driving a common crank shaft 112. The two engines are mounted end-to-end in axially opposing relationship within a single modified outer shell 14', each engine being provided with an upper and lower spherical aligner of which only the adjacent lower aligners 50 are shown. A constricted shell region 118 between the lower spherical aligners 50 of the two engines connects the outer shell portions enveloping each of the two engines. The constricted shell region 118 defines a crankcase within which is disposed a crank-shaft arrangement including drive shaft 112 mounted at right angles to the longitudinal axis of the two engines and driven by the opposing work pistons 104 (only one piston being shown in FIG. 5*a*) through crank-arms 10. The drive shaft 112, as seen in FIG. 5*b* extends through the wall of the crank case 118 to the exterior of the shell 14' for coupling to an engine load. The particular engine and crank case arrangement in FIG. 5*a* is shown to illustrate the mechanical output shaft 12 extending through a low pressure shaft seal 106 in the wall of the shell 14' in the area of crank case 118 as shown in FIG. 5*b*. The crank case space communicates with the buffer spaces defined by the outer shell 14' around each of the two engines and is filled with working gas at the same low presssure as are these buffer spaces, i.e. at atmospheric or preferably slightly above atmospheric pressure. The pressure differential across the seal 106 can thus be kept very low, which greatly facilitates the sealing of the mechanical output shaft to the outer shell 14' as compared to the high pressure seals normally required in similar engines where no working gas filled low pressure buffer space is defined by an outer envelope 14'. It will be understood that while the examples shown in FIGS. 5*a*–5*d* show engine output shafts, the same low pressure shaft sealing principle is applicable to mechanical work input shafts for refrigerator machines.

FIG. 5*c* illustrates the same principle of a low pressure shaft seal 106' for sealing a linearly reciprocating mechanical output shaft 112' extending through a bottlenose extension 118' of an outer shell 14'' enclosing a thermal machine having a compound work piston 104' connected to the output shaft 112' by means of a universal joint 111. Again, only a low pressure dynamic seal 106' is required for sealing the internal space 115 in communication with a buffer space defined by the outer shell 14'' and filled with working gas at relatively low pressure.

Figure 5D:
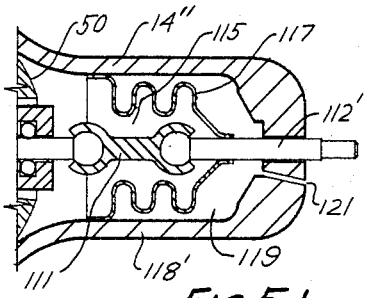
FIG. 5d shows a bellows seal for a linearly reciprocating output shaft.
Figure 5B:
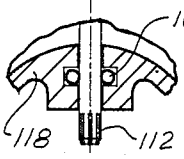

FIG. 5*d* shows an arrangement similar to that of FIG. 5*c* where the dynamic seal 106' of FIG. 5*c* has been replaced by a bellows seal 117 attached between the wall of the outer shell 14'' and the output shaft 112' for sealing the working gas filled space 115. The space 119 on the opposite side of the bellows is vented to the outer atmosphere by an opening 121 in the outer shell 14''. The low pressure differential imposed across the bellows seal 117 makes for greater reliability and prolonged service life of the bellows structure.

Figure 6:
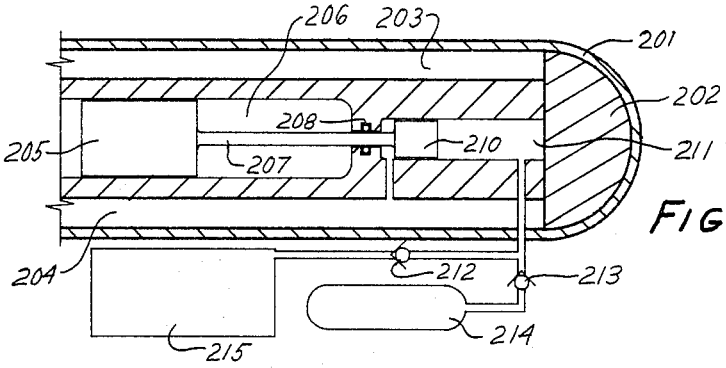
FIG. 6 shows in fragmentary longitudinal section the work output end of an engine constructed as a gas compressor for compressing a gas similar to the working gas used by the engine.

FIG. 6 shows the work output end of a thermal engine particularly adapted for compressing a gas which is the same as the working gas in the engine. The engine is shown only in part, being of conventional construction as to portions not shown, including the usual displacer arrangement. The work piston 205 of the engine works against a gas spring 206 and is connected, by means of a linkage rod 207 extending through seal 208 in the bottom wall of the work piston cylinder to a compressor piston 210 reciprocating in compressor cylinder 211. The engine is enclosed within an outer shell 201 constructed in the manner already described, including a lower spherical aligner 202, it being understood that the engine includes an opposite upper spherical aligner at the thermal end not shown in the drawing. The outer shell 201 defines a buffer space 204 about the engine body 216 filled at low pressure with working gas used in the displacer chamber of the engine. This engine arrangement may advantageously by used as a compressor for compressing a gas produced at low pressure in an external gas generator 215 which generates gas similar to the working gas used in the engine and filling the buffer space 204. The gas generator 215 is connected through check valve 212 to the bottom of the compressor cylinder 211 and is also connected through check valve 213 to a high pressure gas storage tank 214. The top of the compressor cylinder 211 is vented through opening 209 to the engine buffer space 204. As the compressor piston 210 is reciprocated by the work piston 205, low pressure gas from the generator 215 is drawn into and compressed in cylinder 211 for charging the storage tank 214. The advantage of this arrangement is that no sealing is required between the compressor cylinder 211 and the atmosphere because of the intervening buffer space 204. Any leakage of compressed gas into the buffer space is harmless since the gas being compressed is the same as the working gas of the engine and no contamination of the same takes place. Likewise, no contamination of the gas compressed in cylinder 211 occurs since any leakage into the cylinder 211 is of similar gas from the buffer space and therefore it is possible to maintain a high degree of purity of the compressed gas.

FIG. 3 shows a thermal machine 310 having a machine body 312 enclosed in a hermetically sealed outer shell 14 and maintained in axial compression between an upper spherical aligner 48 and a lower spherical aligner 50 in a manner analogous to that of engine 12 in FIG. 1. Like elements in FIGS. 1 and 3 bear like numbering. The shell 14 of FIG. 3 is shown as a single shell without the outer filament winding 52 of FIG. 1. The machine 310 is configured as a refrigerator having a cold finger or refrigerator coil 326, such as an ammonia filled tube connected to cooling coil 328 wound around the cold end of the displacer chamber 24 in the cold head section 320 of the engine body 312.

The piston element 36*b* of the compound work piston 36 in FIG. 3 is driven hydraulically by a hydraulic work input circuit comprising upper and lower hydraulic lines 315 and 317 respectively connected to the hydraulic cylinder 40 on opposite sides of the hydraulic piston element 36*b*, a four-way hydraulic control valve 319, motor driven hydraulic pump 321 and hydraulic fluid reservoir 323. The four-way valve 319 is controlled by an output control signal derived from engine controller 60 so as to control the direction of hydraulic fluid flow through the lines 315, 317 as well as the instantaneous volume of such fluid flow to thereby maintain continuous positive control over the motion of the compound work piston 36. The engine body 312 in FIG. 3 is shown as consisting of two axial sections namely cold head section 320 retained to the remainder 322 of the body 312. The two engine body sections are maintained in axial compression to maintain a gas tight seal at their mating surfaces 321 by means of a static seal 58.

Further distinctions between the FIG. 3 thermal machine and the embodiment of FIG. 1 include provision of an external motor driven gas pump 327 which draws working gas from the low pressure upper buffer space 76 defined in the engine body through conduit 329 and associated check valve, and compresses the gas for storage in high pressure annular storage space 72 through conduit 331. The external gas pump 327 and associated conduits 329, 331 replace part of the pumping arrangement associated with pump cylinder 80 in FIG. 1, and specifically eliminating the gas passages 86 and 88 in FIG. 1. The FIG. 3 machine retains passages 84 and 90 which cooperate with pump pistion 80 for drawing low pressure working gas from the upper buffer space 76, and compressing the same into the displacer chamber 24 through conduit 90. The gas space 338 below piston element **36*a* has been opened to the upper buffer space by means of passage 39 so that pressure in space 338 is equalized with working gas pressure in the upper buffer space 76, as well as with lower buffer space 96*a* through pressure equalizing check valve 98**.

Figure 7:
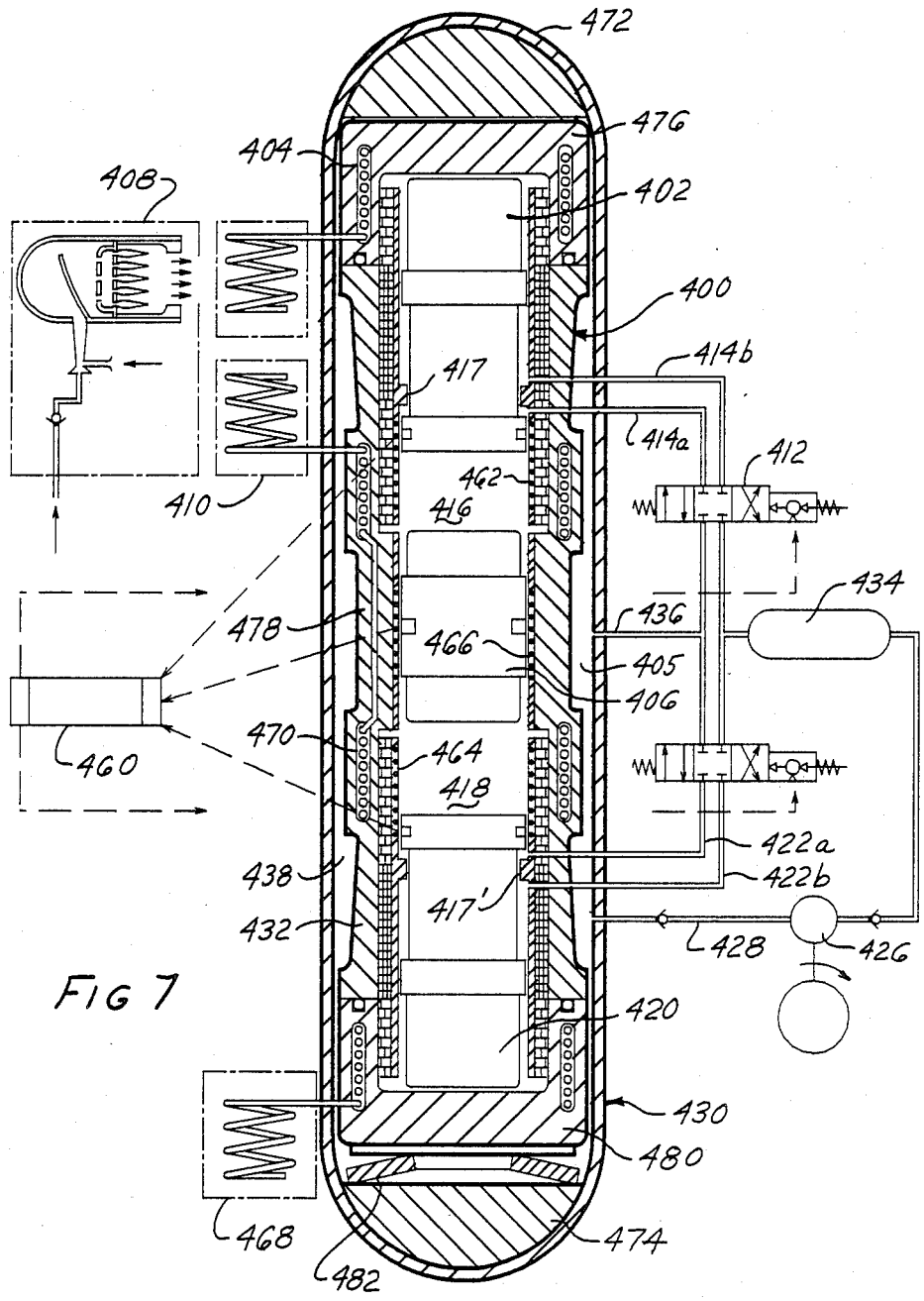
FIG. 7 is a longitudinal section of a thermal machine combining a Stirling cycle engine driving a Stirling cycle refrigerator enclosed in a common outer shell.

Turning now to FIG. 7, a sealed outer shell 430 is shown enveloping a Stirling cycle engine/refrigerator combination thermal machine 400 having a common free work piston 406. The upper portion of the thermal machine 400 is an engine having a displacer 402, a heating coil 404 powered by an external engine burner system 408, and a cooling coil system 410. The displacer 402 is reciprocated by means of a pneumatic control system including four-way pneumatic servo-valve 412 and pneumatic control lines **414*a* and 414*b* which apply a controlled pressure differential on either side of dynamic seal 417, as has explained in connection with similar pneumatic displacer control systems in FIGS. 1–3. The cyclic variations in working fluid pressure in upper displacer chamber 416 drive the work piston 406 which in turn induces corresponding cyclic variations in working gas pressure in a lower displacer chamber 418, thereby producing cyclic variations in working gas temperature in the lower displacer chamber. The machine further comprises a refrigerating coil 468, and a heat sinking coil 470 on the "hot" side of the refrigerator displacer chamber 418 and which is connected to the cooling coil 410 of the engine side of the machine. A second displacer 420 associated with the lower refrigerator section of the machine 400 is similarly pneumatically driven by a controlled pressure differential across seal 417' applied through pneumatic control lines 422*a* and 422*b* and a second four-way pneumatic control servo-valve 424. Pneumatic pressure is supplied by a motor driven pneumatic pump 426 external to the outer shell 430 enclosing the thermal machine and connected through conduit 428 for drawing working gas from the low pressure buffer space 405 defined between the machine body 432 and the wall of outer shell 430. The working gas compressed by pump 426 is stored at high pressure in pneumatic supply tank 434 which feeds the supply control lines 414*b* and 422*b* through the corresponding control servo-valves 412 and 424. The pair of return pneumatic control lines 414*a* and 422*a* are connected through their corresponding control valves 412 and 424 and through common return line 436 to the low pressure working gas filled buffer space 438. Each of the pneumatic control valves 412 and 424 controls the direction and magnitude of the pneumatic pressure differential across the two lines associated with each control servo-valve so as to maintain positive and independent control over the motion of each displacer 402, 420. The realtive phase between the two displacers and the free work piston 406 is controlled by engine controller 460 which receives control inputs from position sensors 462, 464, and 466 which provide position information to the engine controller for the upper displacer, lower displacer and work pistion respectively. The engine controller derives output control signals based on said input information which output signals are connected for controlling the two four-way servo-valves 412, 424**, thus completing the servo-control loop.

In the FIG. 7 example the combined engine/refrigerator is enclosed in a single outer shell 430 having a cylindrical cross-section and closed at each end by hemispherical end sections. Upper and lower spherical aligners 472, 474 respectively are provided between the shell end sections and the upper and lower ends of the machine body 432 so as to maintain the machine body in axial compression, thereby maintaining various machine body sections such as an upper hot head section 476, intermediate body section 478 and lower cold end section 480 in axially compressed, gas sealing relationship as has been earlier described in connection with the various examples of FIGS. 1–3. The axially compressive force is provided by pre-loading spring 482 compressed between the lower end of the engine body and the lower hemispherical aligner 474, thus also maintaining the outer shell 430 in tension between its two ends.

A combination engine/refrigerator such as in FIG. 7 may be advantageously powered by a first source of waste heat for cooling a second source of waste heat, as for example in electronic systems or computers which generate large amounts of heat, the first heat source being selected to be greater than the second heat source.

The current use of metal walled displacer cilinders and chambers is a major contributing factor in the discrepancy between theoretical and practically obtained efficiencies in thermal machines based on Stirling and similar cycles. The steel walls usually found in such machines provide a relatively high conductivity thermal path between the hot and cold ends of the displacer cylinder consequently reducing the temperature differential between the two ends and also between the temperature extremes of the machine operating cycles, thus reducing the work output of an engine or increasing the work input requirement of a refrigerator or heat pump. The metallic displacer cylinder walls further contribute to machine inefficiency by conducting heat from the displacer chamber which is dissipated and lost to the environment.

It is highly desirable to use non-metallic, thermally insulating materials for minimizing these two heat loss paths at the hot end of stirling type engines and similar machines. However, refractory materials such as ceramics or similar materials which have good resistance to very high temperatures and low thermal conductivity, also tend to be brittle and of low tensile strength and perform poorly under tensile loading. This last shortcoming has in the past hampered the use of refractory heat insulating materials for applications where highly pressurized fluids are to be contained e.g. by a ceramic displacer cylinder wall. The present invention overcomes this problem by compressively pre-loading the refractory material against the tensile forces acting on the same in the thermal machine, such that the tensile strength of the refractory element is increased substantially over its normal tensile strength. While a variety of refractory materials may be found suitable, ceramics are presently preferred.

Figure 8:
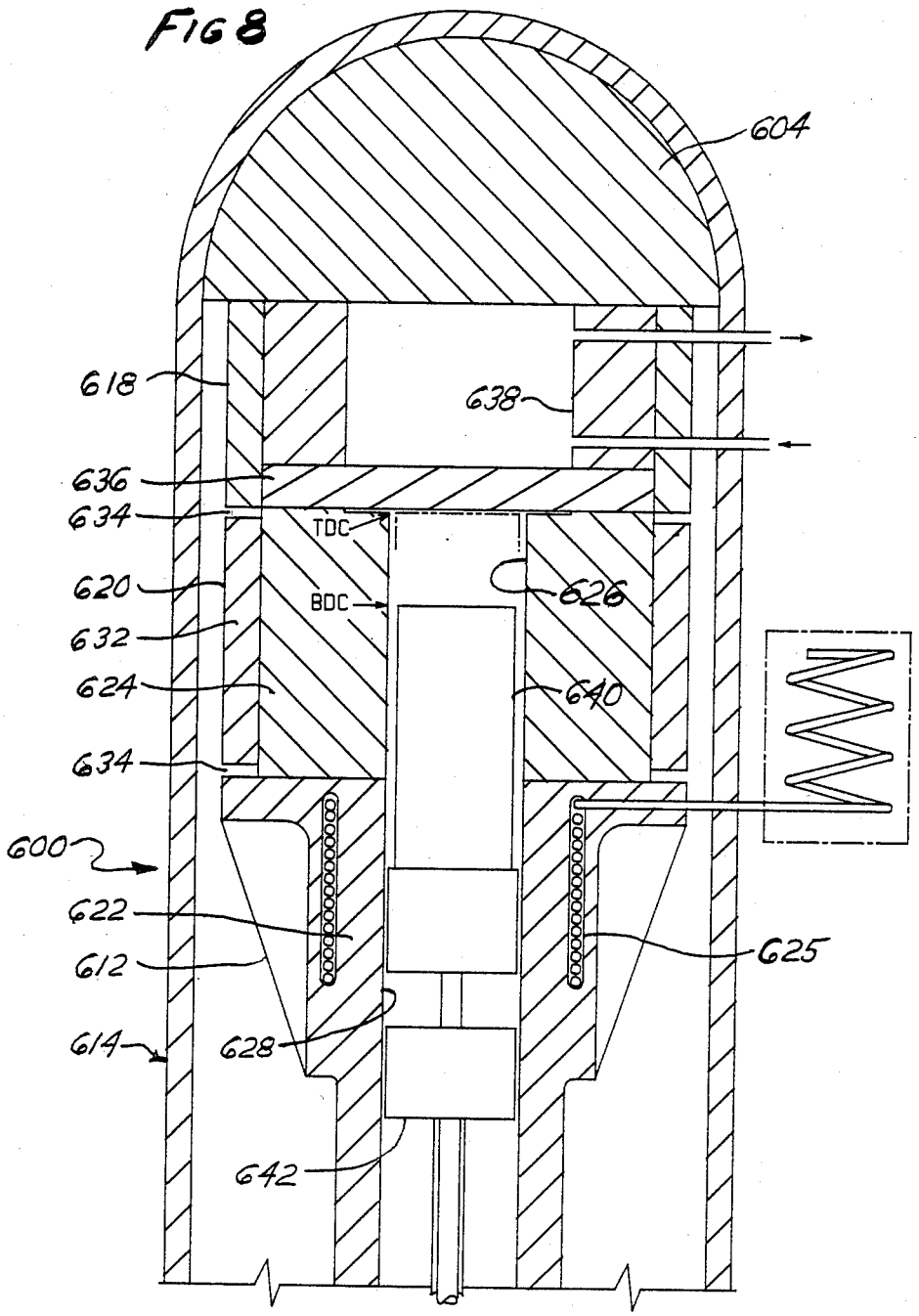
FIG. 8 is a partial longitudinal section of the hot end of a typical thermal machine equipped with refractory hot end insulation according to this invention.

Turn now to FIG. 8 which shows in simplified form the hot end and displacer arrangement of a Stirling cycle machine 600, of the general type shown in FIG. 2, including a machine body 612 comprised of several axial body sections including a heater head section 618, a refractory insulating section 620 and a cold end section 622 which includes a cold sink 625 and extends downwardly to a work output end not shown in FIG. 8. Displacer 640 is reciprocable in the displacer cylinder 630 between an upper hot end and a lower cold end for subjecting a working fluid contained therein to a thermodynamic cycle in cooperation with work piston 642. The heater head 618 in the illustrated example includes a heater cavity 638 through which is circulated molten salt or liquid sodium, and a hot plate 636 through which heat is transfered to thwe working fluid in chamber 630. The various axial body sections are held in axially assembled relationship by an outer shell 614 compressively acting through spherical aligners 604 at each end of the machine body 612 as has already been explained in connection with FIGS. 1 through 7.

The insulating section 620 includes a cylindrical ceramic liner 624 which defines the hot end of the displacer cylinder wall 626, but which may in other embodiments extend into the cold end portion 628 of the same to fully line the displacer cylinder 630, and an outer compression sleeve 632 circumferentially encompassing and radially compressing the refractory liner. The sleeve 632 compressively pre-loads the refractory liner against the outward pressure exerted thereon by the working fluid in the displacer chamber 630.

The ceramic liner is interposed between the hot head 618 and the cold section 622 of the machine body 612 and because of the ceramic's poor thermal conductivity minimizes heat flow between the hot and cold sections. Maximum temperature differential is thus maintained between the two ends of the displacer cylinder for maximum engine efficiency. The ceramic liner further minimizes heat loss through the displacer cylinder wall to the environment and also insulates the compression sleeve against exposure to the high working fluid temperatures so that the sleeve material's acceptable working temperatures are not exceeded. The compression sleeve can therefore be made of high tensile strength metallic materials such as steel alloys, shrunk-fit onto the ceramic liner. The compression ring or sleeve 632 preferably terminates axially slightly short of one or both axial ends of the ceramic liner 624 so that gaps 634 are left between the ring and the axially adjacent machine body sections. Only the ceramic liner 624 makes physical contact with the hot heat 618 and cold section 622 to prevent heat flow through the metallic sleeve from the hot to the cold portions of the machine. For example, a liner constructed of zirconia ceramic, which has a softening point of 3,600 degrees Fahrenheit and a melting point of 4,300 degrees Fahrenheit, can easily withstand engine operating temperatures in the 2,500 degree F. range. Such temperatures are far above the maximum working temperatures of the best stainless steel alloys presently available, such as Inconel which has an upper working temperature limit in the 1,800 degree F. range Ceramics are characterized in that their compressive strength is typically much higher than their tensile strength. For example, zirconia ceramic composed of 4.5% Al203, 91% ZrO2, and 1% SiO2, has a compressive strength of 200,000 psi, while its tensile strength is only 12,000 psi. Pressure exerted by working fluid in the displacer chamber on the liner 624 tends to stretch the liner and is therefore a tensile force, which in a zirconia liner normally could not exceed the aforementioned 12,000 psi figure without leading to structural failure of the liner. The compression ring 632 may be, for example, of stainless steel alloy which can have a tensile strength in excess of 150,000 psi. Such a steel sleeve or ring 632 is shrunk fit around a cylindrical liner 624 of zirconia ceramic, placing the ceramic liner under a radially compressive force of e.g. 100,000 psi. The liner 624 is now pre-loaded by this force acting radially inwardly on the liner, tending to compress the ceramic material. A pre-loading force of this magnitude is well within the compressive strength limits of zirconia ceramic. The working fluid pressure acting on the liner must now exceed the pre-loading force before bringing the ceramic liner into a tensile mode, so that the liner 624 can now contain a working fluid pressence approximately equal to its tensile strength plus the pre-loading force applied by the compression ring 632, in this example 12,000 psi plus 100,000 psi or 112,000 psi of working fluid pressure. It will be clearly appreciated that a large increase in effective tensile strength of a ceramic liner thus becomes possible.

A further and substantial advantage derived from selection of zirconia ceramic as the displacer liner material is that its coefficient of emissivity declines particularly rapidly as the material's temperature rises. The following table compares the coefficients of emissivity of zirconia and silicon carbide ceramics at various temperatures:

| Degrees F. | 800 | 1200 | 1600 | 2000 | 2400 | 2550 |
|---|---|---|---|---|---|---|
| Zirconia Ceramic | .74 | .44 | .33 | .31 | .25 | .22 |
| Silicon Carbide | .95 | .93 | .92 | .90 | .88 | .85 |

At the contemplated engine operating temperatures above 1600 degrees a zirconia ceramic liner becomes a good reflector of infrared radiation in addition to its relatively low thermal conductivity and is therefore makes a superior insulating liner for the displacer cylinder. In particular, a highly reflective cylinder wall 626 reduces the so called shuttle losses whereby heat absorbed by the displacer 640 at the hot end of its stroke (shown in dotted lining) is radiated when the displacer moves towards the cold end 628 of its stroke and thus heats the cylinder wall at locations removed from the heater plate 636.

Silicon carbide on the other hand remains a good absorber of infrared radiation at high temperatures and the hot end plate 636 of the displacer chamber is preferably made of this material for efficiently absorbing heat from the heater, and for readily radiating and releasing the absorbed engergy into the displacer chamber. The radiator plate 636 may be provided with fins or other structures conducive to efficient heat transfer to the working fluid in chamber 630. The entire hot end of the displacer cylinder is thus constructed of ceramic materials and can therefore be operated at temperatures far above those possible with the best available metal alloys. Furthermore, this improvement in performance is achieved while reducing the cost of the components since high temperature steels are costly, while ceramics are relatively inexpensive.

While particular embodiments of the invention have been described and illustrated for purposes of clarity, it will be understood that many modifications, substitutions, and alterations will become apparent to those possessed of ordinary skill in the art. In particular it will be understood that the refractory and ceramic liner arrangements of this invention may be readily modified for use in many types of external combustion engines and other closed cycle thermal machines, including such engines and machines lacking an outer shell or equivalent means and wherein the machine body is assembled by means of conventional fasteners or otherwise. It is therefore intended that the foregoing description be by way of example only and not as limitation of the scope of the invention which is defined only by the following claims.

What is claimed is:

1. A thermal machine comprising:

a machine body comprised of a plurality of axial body sections, said body having two opposite ends;

means compressing said body between said opposite ends for holding said body sections in axially assembled relationship;

a cylindrical displacer chamber in said body having a hot end and a cold end and containing a working fluid, a displacer reciprocable within said displacer chamber for displacing the fluid between the hot and cold ends thereby to subject the fluid to a thermodynamic cycle in cooperation with a compressor piston;

refractory insulation means at least partly defining said displacer chamber and held in axial compression between upper body sections associated with a thermal end of the machine body and lower body sections associated with a work end of the machine body, and means radially compressing said refractory insulation for pre-loading said refractory insulation means against tensile force exerted thereon by said working fluid.

2. The machine of claim 1 wherein said refractory insulation means includes an inner cylinder and said radially compressive means includes an outer cylinder of high tensile strength material.

3. The machine of claim 2 wherein said inner cylinder is a ceramic cylinder and said outer cylinder is metallic.

* * * * *